US010791855B1

(12) United States Patent
Barloga

(10) Patent No.: US 10,791,855 B1
(45) Date of Patent: Oct. 6, 2020

(54) FRAME WITH FERROMAGNETIC TRANSVERSE MEMBERS

(71) Applicant: Roy Barloga, San Leadro, CA (US)

(72) Inventor: Roy Barloga, San Leadro, CA (US)

( * ) Notice: Subject to any disclaimer, the term of this patent is extended or adjusted under 35 U.S.C. 154(b) by 0 days.

(21) Appl. No.: 16/747,993

(22) Filed: Jan. 21, 2020

Related U.S. Application Data

(60) Provisional application No. 62/795,886, filed on Jan. 23, 2019.

(51) Int. Cl.

| | |
|---|---|
| ***A47G 1/17*** | (2006.01) |
| ***A47G 1/16*** | (2006.01) |
| *A47G 1/00* | (2006.01) |
| *A47G 1/06* | (2006.01) |

(52) U.S. Cl.
CPC ..... *A47G 1/17* (2013.01); *A47G 1/1686* (2013.01); *A47G 2001/005* (2013.01); *A47G 2001/0672* (2013.01)

(58) Field of Classification Search
CPC ..... A47G 1/17; A47G 1/1686
USPC ..... 40/600, 711
See application file for complete search history.

(56) References Cited

U.S. PATENT DOCUMENTS 3,289,338 A * 12/1966 Stephens ..... 40/603
5,226,792 A * 7/1993 Darago ..... B60Q 1/50 40/591
6,865,836 B2 * 3/2005 Sachs-Lavery ..... A47G 1/101 40/741
7,086,190 B2 * 8/2006 Voluckas ..... G09F 7/20 248/331
7,296,373 B1 * 11/2007 Hahn ..... G09F 1/12 40/617
8,915,208 B2 * 12/2014 Shanahan ..... G09F 21/04 116/173
9,408,482 B2 * 8/2016 Nesbitt ..... A47G 1/065
9,926,708 B1 * 3/2018 Janko ..... A47G 1/17
10,244,875 B1 * 4/2019 Lydon ..... G09F 15/0012
2002/0189144 A1 * 12/2002 Haggard, Jr. ..... G09F 15/0025 40/597
2016/0360903 A1 * 12/2016 Knowlden ..... G09F 15/0012

FOREIGN PATENT DOCUMENTS

GB 2467568 A * 8/2010 ..... A47G 1/17

* cited by examiner

*Primary Examiner* — Kyle R Grabowski
(74) *Attorney, Agent, or Firm* — Adams Law Office; Sharon Adams

(57) ABSTRACT

A framing system comprising at least two transverse bars made of magnetically attractive, where each transverse bar has two ends, and each end each transvers bar connects by friction alone with a hole in a side rail. The side rails may be flexible or rigid. At least one magnet secures a framed item to at least one ferromagnetic bar by sandwiching the framed item between the magnet and the magnetically-attractive ferromagnetic bar. In preferred embodiments, two magnets secure the top of the framed item to a top ferromagnetic bar and two magnets secure the bottom of the framed item to the bottom ferromagnetic bar.

10 Claims, 4 Drawing Sheets

FRAME WITH FERROMAGNETIC TRANSVERSE MEMBERS

CROSS REFERENCE TO RELATED APPLICATION

This application claims the benefit of U.S. provisional application No. 62/795,886, filed Jan. 23, 2019, and naming Roy Barloga as the inventor, which is hereby incorporated by reference in its entirety.

STATEMENT REGARDING FEDERALLY SPONSORED RESEARCH

Not applicable.

NAMES OF THE PARTIES TO A JOINT RESEARCH AGREEMENT

Not applicable.

STATEMENT REGARDING PRIOR DISCLOSURES

The inventor hereby discloses U.S. patent application Ser. No. 29/680,617, filed on Feb. 18, 2019.

BACKGROUND OF THE INVENTION

Many people frame prints, posters, artworks, or other items. The framed items may be comprised of flexible material such as paper, canvas, or fabric, or may be of stiff material, and may be of any size or shape.

Existing frames often come in standard sizes with immoveable, solid borders. A frame may have to be custom made if the framed item has a non-standard size or shape. Existing frames are often cumbersome and may require multiple steps to secure a framed item to the frame. And existing frames often require additional materials, including matting, glass, and backings.

There exists a need for adjustable frames that easily secure framed items of a variety of sizes and shapes to the frame, without the need for additional materials.

BRIEF SUMMARY OF THE INVENTION

The invention consists of a frame with at least two transverse ferromagnetic bar and at least two longitudinal side rails that are connected with the ferromagnetic bars using only friction. The side rails may be flexible or rigid, and may be positioned at any location along the ferromagnetic bar. Magnets secure a framed item to the ferromagnetic members by sandwiching the framed item between at least one magnet and at least one ferromagnetic member.

BRIEF DESCRIPTION OF THE SEVERAL VIEWS

DETAILED DESCRIPTION OF THE INVENTION

Many people frame prints, posters, artworks, or other solid or flexible items (collectively a "framed item"). The top end of a framed item 105 may comprise a flat horizontal end, an angled end, a curved end, a point, or any other end that is at the top of a framed item. The bottom end of a framed item may comprise a flat horizontal end, an angled end, a curved end, a point, or any other end that is at the bottom of a framed item. Similarly, the left side of a framed item and the right side of a framed item may comprise a plumb vertical end, an angled end, a curved end, a point, or any other end that is at the left or right side respectively of a framed item. The framed item has a top surface that displays the artwork and faces outward when the framed item is hung. The invention described herein may frame any of these framed items.

Figure 3:
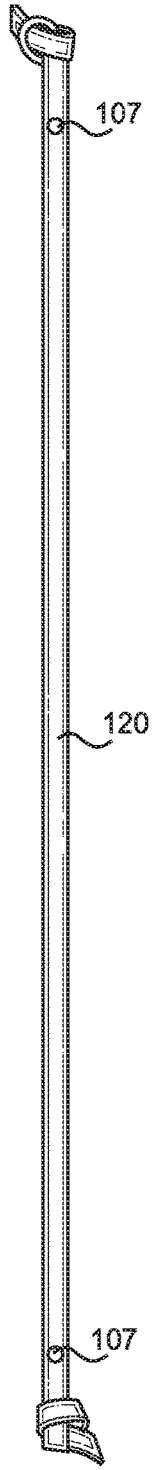
FIG. 3 is side elevational view of one flexible side rail.

The invention consists of a frame with at least two magnetically-attractive ("ferromagnetic") bars 110 and at least two side rails that are connected with the ferromagnetic bars using only friction. Each side rail has a top hole 107 to receive one end of the top ferromagnetic bar, and a bottom hole 107 to receive one end of the bottom ferromagnetic bar, as shown in FIG. 3. At least one magnet 103 secures a framed item to a transverse ferromagnetic member by sandwiching the framed item between the magnet 103 and ferromagnetic bar 110.

Figure 1:
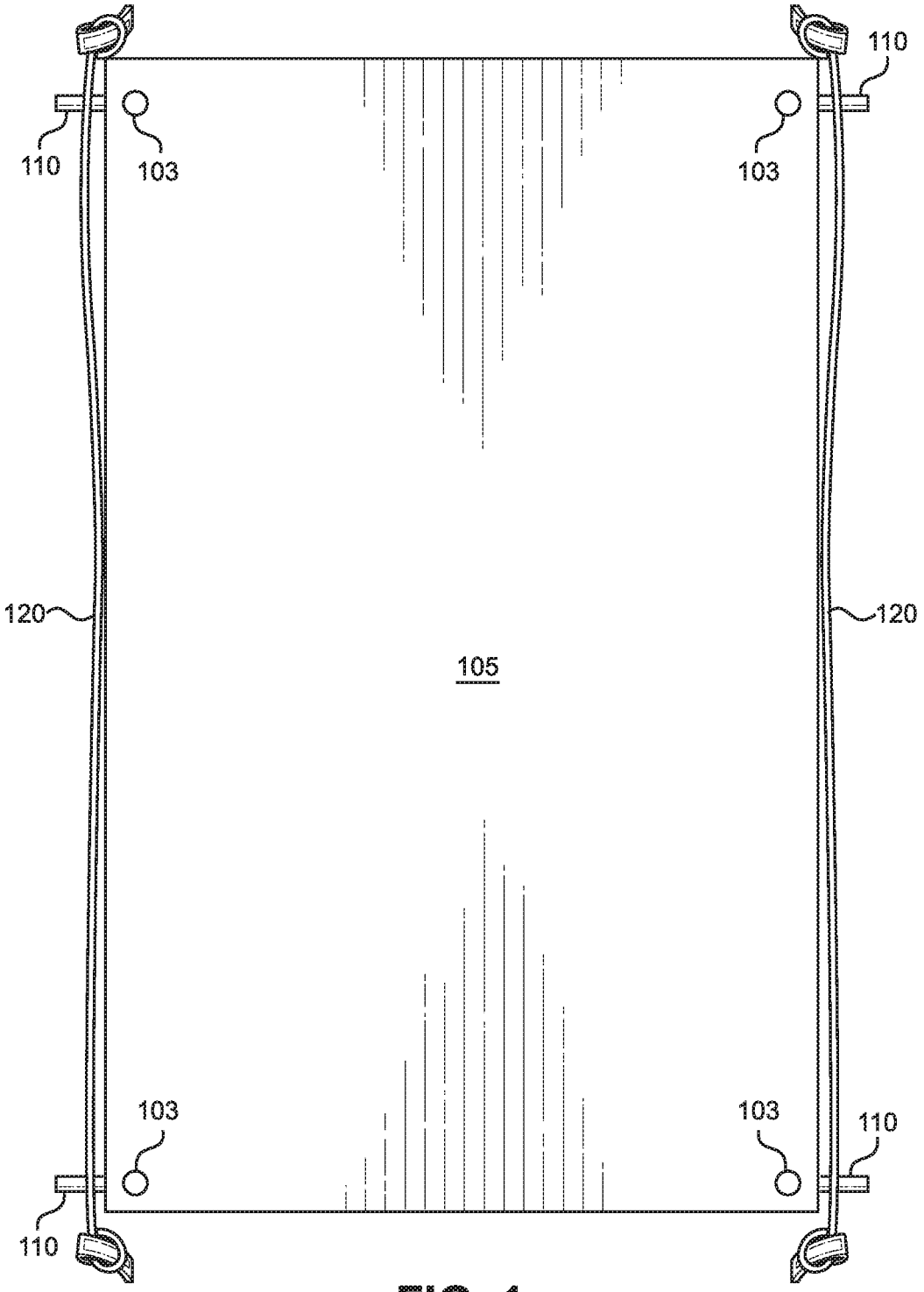
FIG. 1 is a front elevational view of an embodiment of the frame with flexible side rails, ferromagnetic bars, and magnets securing a framed item to the ferromagnetic bars.
Figure 6:
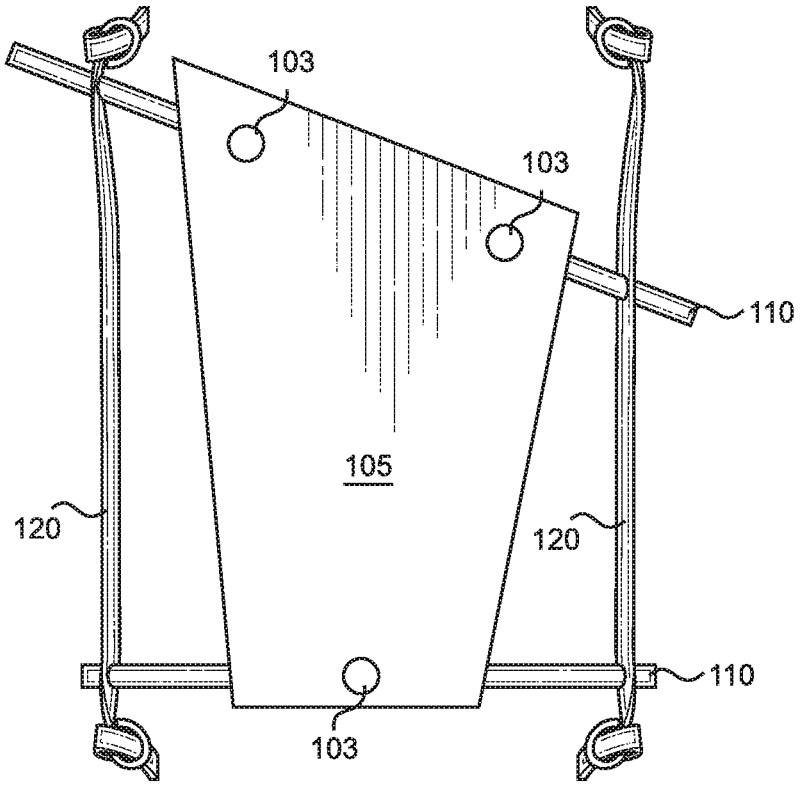
FIG. 6 is a front elevational view of another embodiment of the invention.

The ferromagnetic bars 110 may comprise a top ferromagnetic bar and a bottom ferromagnetic bar. Each ferromagnetic bar has a left end and a right end. A top ferromagnetic bar is a frame member that is proximate to the top end of a framed item. At least one magnet secures a top end of a framed item to the top ferromagnetic bar. A bottom ferromagnetic bar is a frame member that is proximate to the bottom end of a framed item. At least one magnet secures a bottom end of a framed item to the bottom ferromagnetic bar. Each ferromagnetic bar may be horizontal, as shown in FIG. 1. Or, as a non-limiting example shown in FIG. 6, a ferromagnetic member may be at an angle.

Figure 5:
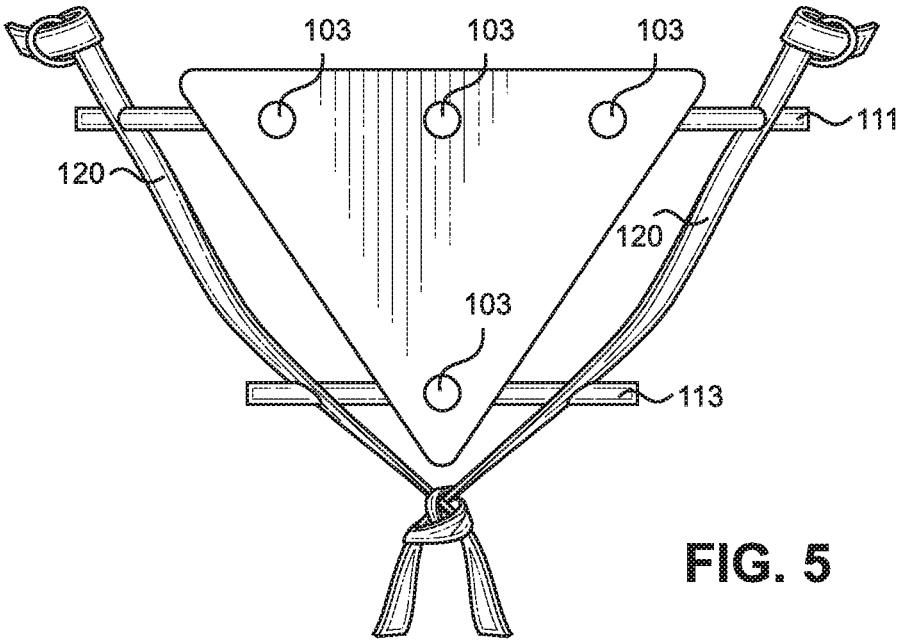
FIG. 5 is a front elevational view of another embodiment of the invention.

Likewise, a side rail is defined to include a frame member that is proximate to a left side end or a right side end of a framed item 105. A side rail may often be plumb vertical, as shown in FIG. 1. Or, as shown in FIG. 5 in a non-limiting example, a side rail may be at an angle.

Figure 2:
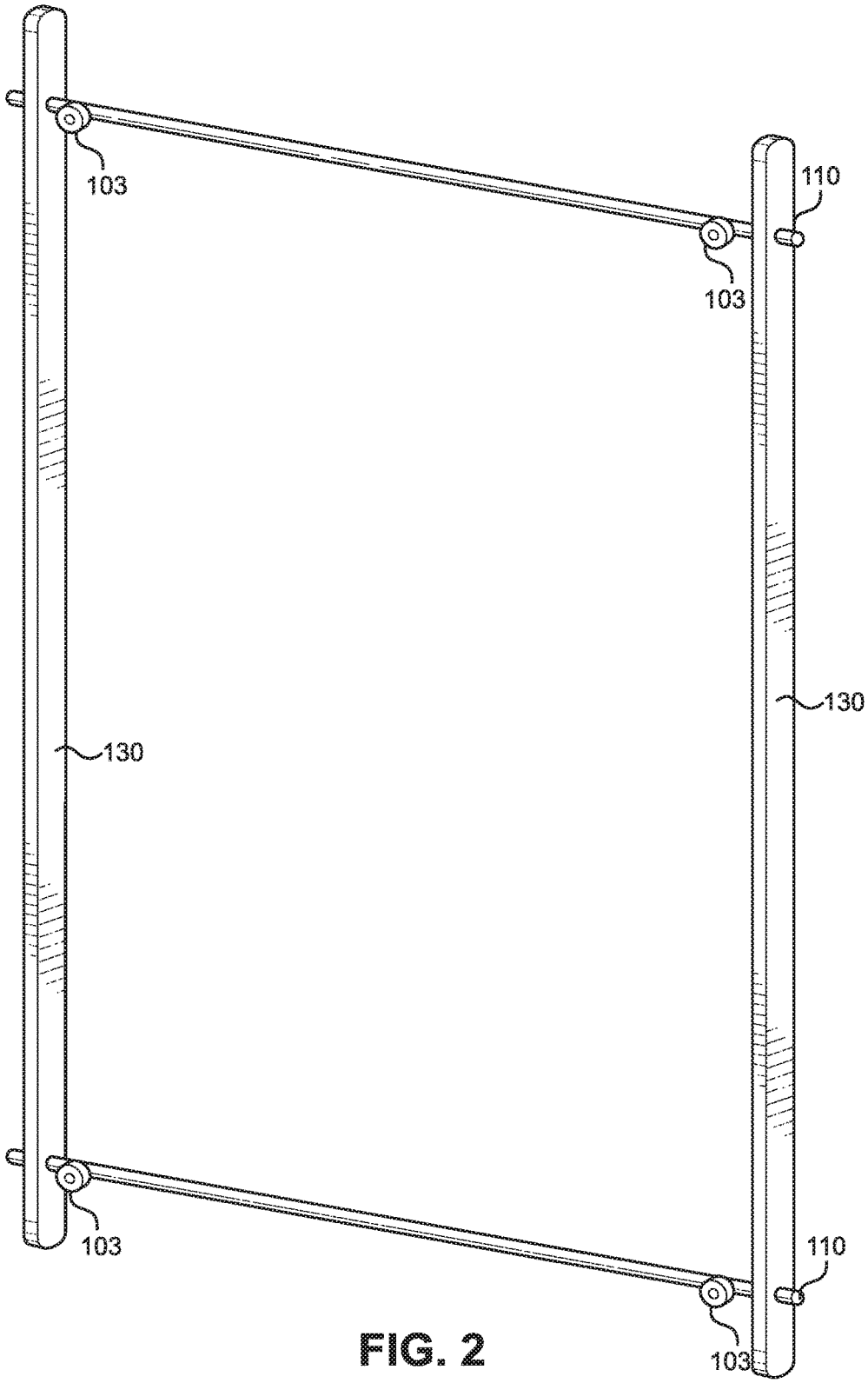
FIG. 2 is a perspective view of an embodiment of the frame with rigid side rails.

Some embodiments comprise at least two side rails 120 that are flexible, as shown in FIG. 1. Other embodiments comprise at least two side rails 130 that are rigid, as shown in FIG. 2. Still other embodiments may comprise a mixture of flexible and rigid side rails. Each side rail comprises at least two holes, a top hole 107 and a bottom hole 107. Each hole 107 is sized to receive an end of the ferromagnetic bar, and retain the end of the ferromagnetic bar in place due to friction.

The flexible side rails may comprise any flexible material, including but not limited to leather, cloth, ribbon, rubber, vinyl, composite flexible materials, or any other flexible material. In one preferred embodiment the flexible side rails comprise leather strips.

The rigid side rails 130 may be made from any rigid material, including but not limited to wood, metal, ferromagnetic material, plastic, wood laminate, composite rigid materials, or any other rigid material.

Figure 4:
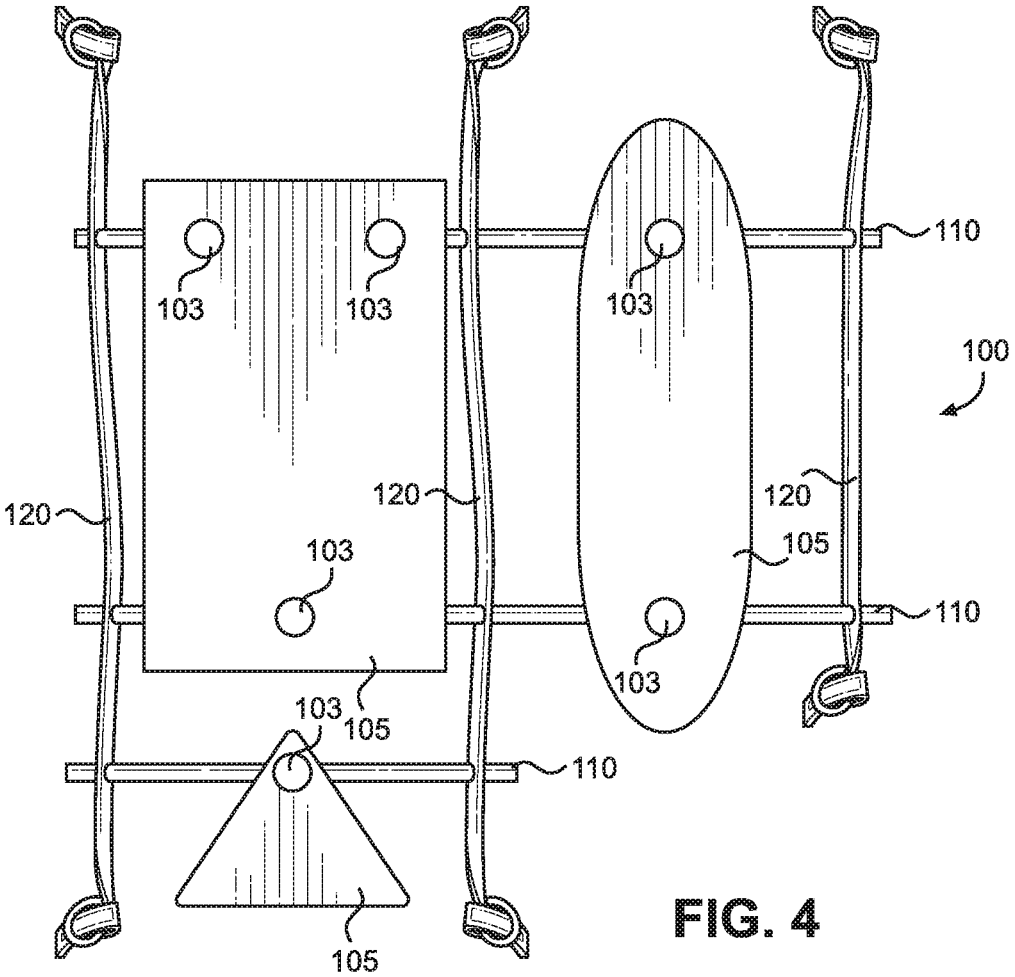
FIG. 4 is a front elevational view of an embodiment of the invention with a plurality of flexible side rails, and a plurality of ferromagnetic bars.

The side rails may be positioned at any point along the ferromagnetic bars. This allows the frame size to be adjusted to accommodate the size of the framed item. For example, an internal side rail may be positioned in the middle of a ferromagnetic bar, as shown in FIG. 4.

At least one magnet 103 secures a framed item 105 to at least one ferromagnetic bar 110. To secure a framed item to the frame, the length dimension between the top ferromagnetic bar and the bottom ferromagnetic bar must be less than the length dimension of the framed item. A first magnet is disposed on a top surface of the framed item, sandwiching the framed item between the first magnet and the top ferromagnetic bar, and securing the framed item to the top ferromagnetic bar. Additional magnets may be disposed on the top surface of the framed item, sandwiching the framed item between the additional magnet and the top and bottom ferromagnetic bar, thereby securing the framed item to the bottom ferromagnetic bar.

The ferromagnetic bars may be of any transverse length dimension desired or needed to frame a framed item and secure the framed item in place using magnets. Likewise, the longitudinal length of the side rails, and the spacing between the holes 107 on the side rails, may be of any dimension desired or needed to frame a framed item.

The frame and the procedure for forming the frame and securing a framed item to the frame is the same whether the frame uses rigid side rails or flexible side rails.

A first side rail forms a left side of the frame and is proximate to a left end of a framed item. A second side rail forms the right side of the frame and is proximate to a right end of a framed item. Each side rail has a top end and a bottom end. Each side rail is of sufficient width to have a first hole 107 the top end and a second hole 107 at the bottom end, where the hole is sized to accommodate a ferromagnetic bar 110. Additional side rails may be used to frame multiple items, as shown in FIG. 4. The length of the side rails, and the length distance between the top hole and the bottom hole may be any length as desired, so long as the distance between the top hole and the bottom hole is less than the length of the framed item.

There is a size relationship between each hole 107 and the associated end of a ferromagnetic bar. Each hole 107 has a hole boundary dimension and each end of a ferromagnetic bar 110 has an end perimeter dimension. Each hole boundary dimension is sized to receive a corresponding perimeter dimension of one ferromagnetic bar and retain the ferromagnetic bar in place due to friction. No other hardware is needed to secure the ferromagnetic bar to the hole 107. Friction alone keeps the two together.

It is apparent that the size of a hole boundary dimension and any corresponding end perimeter dimension may be varied as needed or desired, as long as the size relationship between the hole boundary dimension and the end diameter dimension allows the ferromagnetic bar to slide within the hole while simultaneously having sufficient friction to retain the ferromagnetic bar in place.

As used herein "hole" is defined to include any shape, including square, rectangle, oval, or any other shape, and "boundary" is defined to include the boundary edge size of any shape, including square, rectangle, oval, circular, or any other shape. Likewise, the "end" of a ferromagnetic bar is defined herein to include any shape, including square, rectangle, oval, or any other shape, and "perimeter" is defined to include the boundary edge size of any shape. In all cases, the size and shape of the hole boundary corresponds to the size and shape of the perimeter of the ferromagnetic bar, so that the end perimeter fits into the hole and can be moved along the ferromagnetic bar, but also will remain in place due to friction when not be moved.

A frame is formed by inserting the left end (the "first end") of the top ferromagnetic bar 110 into top hole 107 in the left side rail and sliding the side rail along the ferromagnetic bar until the left side rail is at a desired location; inserting the right end (the "second end") of the top ferromagnetic bar 110 into the top hole 107 in the right side rail and sliding the right side rail along the ferromagnetic bar until the right side rail is in the desired location; inserting the left end (the "first end") of the bottom ferromagnetic bar 120 into the bottom hole 107 in the left side rail and sliding the side rail along the ferromagnetic bar until the left side rail is at a desired location; and inserting the right end (the "second end") of the bottom ferromagnetic bar 110 into the bottom hole 107 in the right side rail and sliding the right side rail along the ferromagnetic bar until the right side rail is in the desired location. Additional rails may be used. For each additional side rail, the end of a ferromagnetic bar is inserted into the corresponding hole in the side rail, and the side rail is slide along the ferromagnetic bar to a desired position. These steps need not be performed in the order described above, these steps may be performed in any order.

A framed item 105 is connected with the frame by positioning the framed item so that the top edge of the framed item is above the top ferromagnetic bar 110. At least one magnet 103 is used to secure the framed item to a ferromagnetic bar by disposing the magnet along the top ferromagnetic bar, and sandwiching the framed item between the magnet and the ferromagnetic bar, as shown in FIG. 4. In other embodiments, two magnets are used, wherein a first magnet secures framed item 105 to the top ferromagnetic bar 110, and a second magnet secures framed item 105 to the bottom ferromagnetic bar 100, as shown in FIG. 4. In other embodiments three magnets may be used, as shown in FIG. 4, or four magnets may be used as shown in FIGS. 1 and 4. It is apparent that any number of magnets may be used. In addition, the framed item 105 may be of any shape, including but not limited to circular, oval, or triangular, as shown in FIGS. 4 and 5.

Some embodiments comprise options for forming frames and frame shapes, and options for framing differently shaped items, or framing more than one item. In some embodiments, the side rails may have more than two holes to receive more than two ferromagnetic bars, as shown in FIG. 4. In these embodiments, side rails 120 or 130 have a top hole 107, a bottom hole 107, and may have as many additional holes 107 as needed to connect with as many ferromagnetic bars as needed.

In still other embodiments, the invention may have more than two side rails. As a non-limiting example, there may be three rails connected with two transverse ferromagnetic bars, with a left side rail on the left side of the framed item, a right side rail on the right side of a second framed item, and an internal side rail between the two framed items, as shown in FIG. 4. There may be more than one internal side rail.

Figure 7:
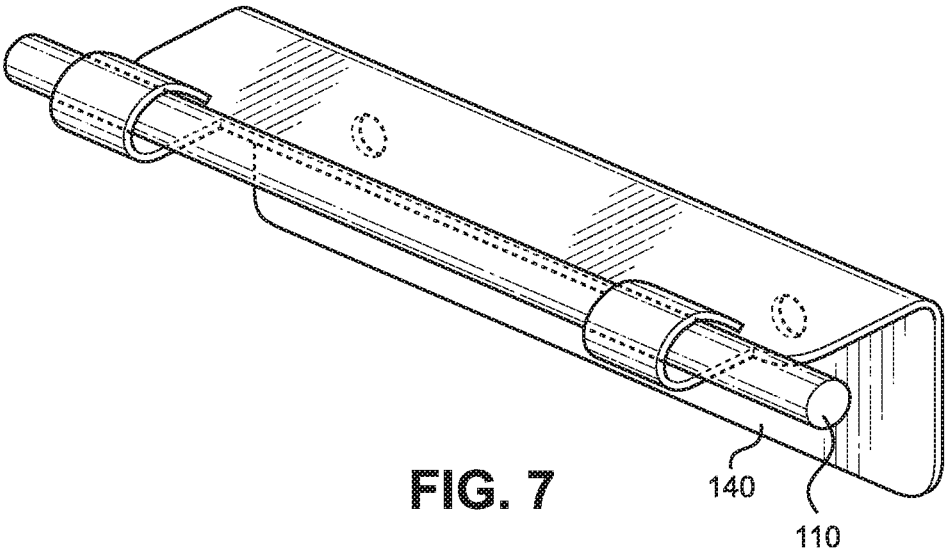
FIG. 7 is a perspective view of an embodiment of the attachment assembly.

In some embodiments, the frame may be attached to a wall or hanging surface using attachment assembly 140. Attachment assembly may be connected with a ferromagnetic bar 110, as shown in FIG. 7. The attachment structure may also be any means known in the art to attach a frame to a wall or other vertical hanging surface. It is apparent that the attachment structure may be connected with other parts of the frame, as needed or desired.

It should be understood that the drawings and detailed description are not intended to limit implementations to the particular form disclosed but, on the contrary, the intention is to cover all modifications, equivalents and alternatives falling within the spirit and scope as defined by the appended claims. Certain features or components herein may be shown in somewhat schematic form and some details of conventional elements may not be shown or described in the interest of clarity and conciseness.

The headings used herein are for organizational purposes only and are not meant to be used to limit the scope of the description or the claims.

As used throughout this application, the word "may" is used in a permissive sense (i.e., meaning having the potential to), rather than the mandatory sense (i.e., meaning must). Similarly, the words "include," "including," and "includes" mean including, but not limited to.

While implementations are described herein by way of example, the implementations are not limited to the examples or drawings described. However, it is susceptible to modifications and alternate constructions from the embodiments shown in the figures and accompanying description. Consequently, it is not intended that the invention be limited to the particular embodiments disclosed. On the contrary, the invention is intended to cover all modifications, sizes and alternate constructions falling within the spirit and scope of embodiments of the invention. The drawing figures are not necessarily to scale. Certain features or components herein may be shown in somewhat schematic form and some details of conventional elements may not be shown or described in the interest of clarity and conciseness.

What is claimed is:

1. A device for framing items comprising, a framed item, a top ferromagnetic bar proximate to a top end of a framed item, wherein the top ferromagnetic bar has a first end with a perimeter dimension and a second end with a perimeter dimension, a bottom ferromagnetic bar proximate to a bottom end of the framed item, wherein the bottom ferromagnetic bar has a first end with a perimeter dimension and a second end with a perimeter dimension, a left side rail proximate to a left side of the framed item, wherein the left side rail further comprises a top hole with a boundary dimension that corresponds to the perimeter dimension of the first end of the top ferromagnetic bar, and a bottom hole with a boundary dimension that corresponds to the perimeter dimension of the first end of the bottom ferromagnetic bar, and wherein the distance between the top hole and the bottom hole is less than the length of the framed item, a right side rail proximate to a right side of the framed item, wherein the right side rail further comprises a top hole with a boundary dimension that corresponds to the perimeter dimension of the second end of the top ferromagnetic bar and a bottom hole with a boundary dimension that corresponds to the perimeter dimension of the second end of the bottom ferromagnetic bar, and wherein the distance between the top hole and the bottom hole is less than the length of the framed item, the first end of the top ferromagnetic bar connects with the top hole of the left side rail and remains in place by friction, the first end of the bottom ferromagnetic bar connects with the bottom hole of the left side rail and remains in place by friction, the second end of the top ferromagnetic bar connects with the top hole of the right side rail and remains in place by friction, the second end of the bottom ferromagnetic bar connects with the bottom hole of the right side rail and remains in place by friction, a first magnet disposed on a top surface of the framed item, sandwiching the framed item between the first magnet and the top ferromagnetic bar, and a second magnet disposed on the top surface of the framed item, sandwiching the framed item between the second magnet and the bottom ferromagnetic bar.

2. The device of claim 1 wherein each side rail is flexible.

3. The device of claim 2 wherein each side rail is made of leather.

4. The device of claim 2 wherein each side rail is rigid.

5. The device of claim 1 with at least one internal side rail.

6. The device of claim 5 wherein each internal side rail is flexible.

7. The device of claim 5 wherein each internal side rail is rigid.

8. The device of claim 1 wherein at least two magnets sandwich the framed item between the magnets and the top ferromagnetic bar, and at least two magnets sandwich the framed item between the magnets and the bottom ferromagnetic bar.

9. The device of claim 1 further comprising at least one additional ferromagnetic bar with a left end with a perimeter dimension and a right end with a perimeter dimension, wherein each side rail further comprises at least one additional hole with a boundary dimension that corresponds to at least one perimeter dimension of the additional ferromagnetic bar.

10. The device of claim 1 further comprising an attachment assembly connecting the device with a hanging surface.

* * * * *